United States Patent [19]

Baba et al.

[11] Patent Number: 4,779,804

[45] Date of Patent: Oct. 25, 1988

[54] ELECTROSTATIC PAINTING GUN

[75] Inventors: Youichiro Baba; Hirofumi Hashimoto, both of Toyota; Kenji Tamura, Nagoya, all of Japan

[73] Assignee: Toyota Jidosha Kabushiki Kaisha, Toyota, Japan

[21] Appl. No.: 89,769

[22] Filed: Aug. 27, 1987

[30] Foreign Application Priority Data

Sep. 10, 1986 [JP] Japan ..... 61-139043[U]

[51] Int. Cl.[4] ..... B05B 5/02

[52] U.S. Cl. ..... 239/690; 239/587; 901/43

[58] Field of Search ..... 239/704, 705, 706, 708, 239/690, DIG. 14, 587, 280, 280.5, 525; 901/43; 118/695, 696, 697, 698, 699

[56] References Cited

U.S. PATENT DOCUMENTS 4,323,196 4/1982 Logue et al. ..... 239/587
4,660,772 4/1987 Rice ..... 239/704
4,690,327 9/1987 Takai et al. ..... 239/587

FOREIGN PATENT DOCUMENTS 3126936 2/1983 Fed. Rep. of Germany ..... 239/690
3526958 12/1985 Fed. Rep. of Germany ..... 118/698
60-244358 4/1985 Japan .
2161095 7/1984 United Kingdom ..... 239/690

*Primary Examiner*—Andres Kashnikow
*Assistant Examiner*—Chris Trainor
*Attorney, Agent, or Firm*—Oblon, Fisher, Spivak, McClelland & Maier

[57] ABSTRACT

An electrostatic painting gun for painting minute places which are hard to reach is disclosed. The electrostatic painting gun includes a bent rod-shaped gun and a bracket which are arranged so as to form a trapezoid-like pocket space. The trapezoid-like pocket space serves to provide the electrostatic painting gun with better accessibility to the minute places.

5 Claims, 4 Drawing Sheets

ELECTROSTATIC PAINTING GUN

BACKGROUND OF THE INVENTION

1. Field of the Invention:

This invention relates to a painting gun used for electrostatic painting, and more particularly, to an improvement in configurations of the painting gun.

2. Discussion of the Background:

Recently, the ratio of painting processes employing robots utilized has shown a sharp increase in the manufacturing processes of automobiles and similarly complex machines. This has the object of organizing painting operations and improving painting qualities. The electrostatic painting method has been employed in the manufacturing processes because the method has the advantages of offering decreased paint loss and providing improved wettability.

As for electrostatic painting guns, a few of them have been developed especially for robots. For many cases, an electrostatic painting gun used by a human operator, disclosed in Japanese Published Unexamined Patent Application No. 244358/1985, and an electrostatic painting gun for reciprocating painting are used without modification in the above mentioned painting processes. As for an electrostatic painting gun especially developed for robot application, TRP-402 TM manufactured by Thermes Co. is well known and is shown in FIG. 11.

It is known that the center axis of a painting gun nozzle opening should be held perpendicular to the surface of an object to be painted for performing quality painting. However, the conventional type of electrostatic painting hand gun and the electrostatic painting gun for reciprocating painting have straight configurations in which the nozzle opening coincides with the center axis of the gun, and the guns have supply hoses, such as a paint hose, an air hose, etc., extending from their outer surfaces. Accordingly, the guns and the hoses come into contact with an object to be painted when painting minute places Z as shown in FIGS. 8 to 10 with said guns being supported by a robot wrist. As a result, the painting quality at such places is deteriorated, or painting can not be performed at such places in the worst cases, because it is hard to hold the gun in the optimum posture perpendicular to the surface of an object to be painted. Thus, additional painting by a human operator is required for the minute places before or after the painting performed by a robot.

The TRP-402 TM gun shown in FIG. 11 is known to be useful for solving such problems to a certain degree. The electrostatic painting gun comprises a gun 100 and a bracket 101 installed on the gun at a predetermined angle. A high voltage generator and a paint regulator are built-in to the bracket 101. In addition, hoses 102 for supplying a paint, air and power are built-in to the bracket 101 and a robot wrist 200.

However, it is inevitable that the size of the bracket 101 becomes larger in the above-noted type electrostatic painting gun. Thus, the minute places which are hard to reach can not be painted properly, and it is difficult to clean the electrostatic painting gun. Further, it is difficult to teach painting operations to the robot because the nozzle opening is disposed away from the center axis of the robot wrist center axis. Furthermore, application of the electrostatic painting gun has been limited to a robot having a wrist which can store the hoses within the wrist.

SUMMARY OF THE INVENTION

Accordingly, it is an object of the present invention to solve the foregoing problems of the prior art.

It is another object of the present invention to provide an electrostatic painting gun suitable for painting minute places which are hard to reach.

It is another object of the present invention to provide an electrostatic painting gun applicable to any type of robot.

It is a further object of the present invention to provide an electrostatic painting gun allowing for easy teaching operation of the robot.

An electrostatic painting gun according to the present invention has the following features: The electrostatic painting gun comprises a rod-shaped gun bent around its middle, having a front end with a nozzle opening, and a rear end connected to hoses for respectively supplying paint, air and power; and an integrally formed bracket installed on the rear end of the gun. The bracket extends so as to form a trapezoid-like pocket space between itself and said gun, and an extension end of the bracket has a connecting portion for connection with a robot wrist.

One of the feature of the electrostatic painting gun according to the present invention is the trapezoid-like pocket space formed by the bent portion of the gun and bracket.

The gun is bent around its middle portion. The nozzle opening is disposed on the front end of the gun, and the hoses are disposed on the rear end of the gun. The bent portion around the middle may either be bent at an angle or curved in an arc shape. The bracket installed on the rear end of the gun extends on the same side where the front end of the gun is located, and the extension end of the bracket has a connecting portion to be connected with a robot wrist. The bracket may either extend at an angle with respect to the gun or have a curved shape ike an arc. This, the trapezoid-like pocket space is formed by the bent portion of the gun and the bracket. Because of the trapezoid-like pocket, the nozzle opening is positioned in the optimum posture when painting minute places which are otherwise hard to reach.

The center axis of the robot wrist fixed with the connecting portion preferably intersects the center axis of the front end of the gun at an angle of between 45° to 60° , and the center axis of the front end of the gun preferably intersects the center axis of the rear end of the gun at an angle of between 120° to 150° . If the intersecting angles are kept respectively within the above-noted ranges, the trapezoid-like pocket space can be maintained as large as possible, and the direction of the center axis of the nozzle opening becomes optimum.

Further, the center axis of the robot wrist preferably intersects the center axis of the rear end of the gun at an angle of 30° or less. By virtue of this arrangement, an angle formed between the hoses extending from the rear end of the gun and the robot arm becomes smaller. Thus, the hoses can be prevented from contacting with an object to be painted.

Another feature of the electrostatic painting gun according to the present invention is that the hoses for supplying paint, air and power are disposed altogether on the rear end of the gun. Accordingly, the outer surface of the gun is free from protrusions, and the gun's degrees of freedom of movement becomes larger even when painting the minute places which are hard to reach.

A paint supply valve for controlling turning on and off the paint discharge is built-in to the gun as in a conventional type electrostatic painting gun. Also, a high voltage generator should be preferably built-in to the gun. Hence, a low voltage type power hose can be used for the power supply hose connecting the gun and the power source. Because the low voltage type power hose is smaller in diameter and more flexible than the high voltage power hose of the conventional type, the low voltage type power hose follows the movements of the robot arm well, and cable rupture problems can be prevented from occurring. Even if the low voltage type power hose should rupture, it is relatively safe because only a low voltage current flows through it.

The gun is cylindrical with a hollow space formed in it. The hoses may be disposed within the hollow space. The preferred embodiment of the electrostatic painting gun has hoses disposed together on the rear end of the gun. The gun may be formed of a solid cylinder, and a plurality of passages may be provided through it. In this case, paint, air, and power may be supplied through the passages.

Except for the above-noted configuration, the electrostatic painting gun of the present invention has the same interior construction as that of the conventional type electrostatic painting gun. A high voltage generator, a paint supply valve and a nozzle of the conventional type electrostatic painting gun are disposed within the electrostatic painting gun.

The electrostatic painting gun according to the present invention has a pocket space formed by the gun and the bracket. As a result, the center axis of the nozzle opening and the center axis of the robot wrist intersect at a predetermined angle, and the nozzle opening can be positioned in a posture perpendicular to the surface of an object to be painted even when painting a minute place as shown in FIG. 8 which is otherwise hard to reach. Because the electrostatic painting gun has the pocket space, it can extend beyond obstacles and reach minute places, such as the places shown in FIGS. 9 and 10, to paint the objects. Further, because the nozzle can be disposed adjacent the center axis of the robot wrist according to the present invention, it is easier to teach painting operations to a robot with the electrostatic painting gun than to a robot with the conventional type electrostatic painting gun.

Additionally, the electrostatic painting gun according to the present invention has hoses for supplying paint, air and power and are disposed together on the rear end of the gun. Accordingly, the hoses can be prevented from contacting an object to be painted, and can be extended smoothly toward the rear end of the robot arm because the extending direction of the hoses naturally becomes unidirectional.

Accordingly, quality painting can be achieved because minute places, which are otherwise hard to reach, can be painted by the electrostatic painting gun according to the present invention in the optimum posture, and no additional painting by human operators is required. In addition, as previously mentioned, it is easy to teach painting operations to a robot with electrostatic painting gun according to the present invention. Thus, the man-hour requirements can be reduced sharply as compared with using a robot employing the conventional type electrostatic gun. Furthermore, according to the present invention, it is not necessary to install the electrostatic painting gun on a special type robot, but rather, robots which have been conventionally used are usable without modifications.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Having generally described this invention, a further understanding can be obtained by reference to certain specific examples which are provided herein for purposes of illustration only and are not intended to be limiting unless otherwise specified. A preferred embodiment of an electrostatic painting gun according to the present invention will now be explained in detail.

Figure 1:
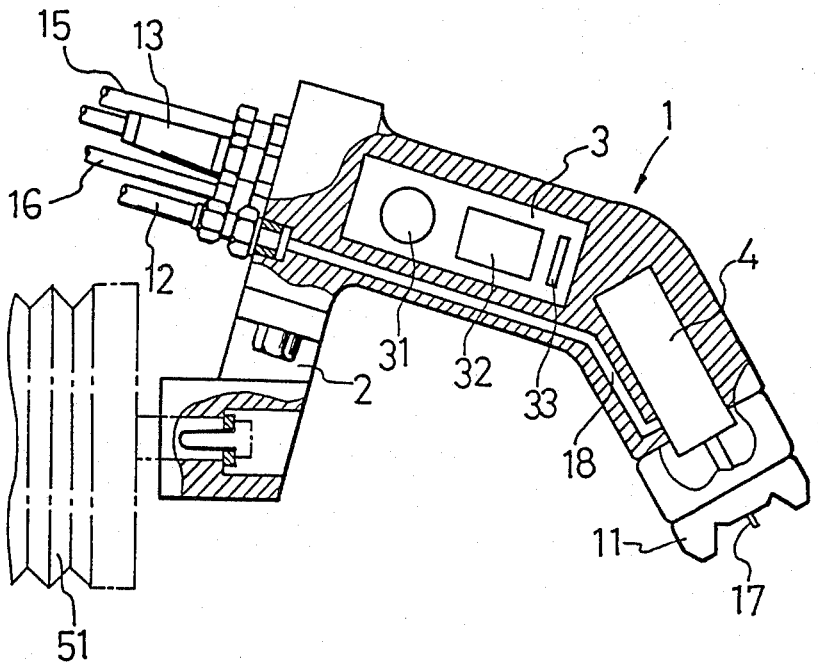
FIG. 1 is a schematic front view of the electrostatic painting gun in accordance with the present invention partly in section.
Figure 2:
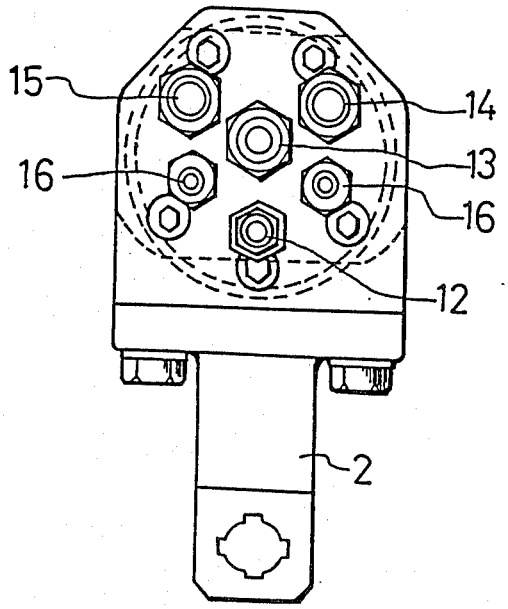
FIG. 2 is a side view of the electrostatic painting gun viewed from the rear.

FIGS. 1 and 2 illustrate a preferred embodiment of an electrostatic painting gun according to the present invention. The electrostatic painting gun comprises a gun 1 and a bracket 2. The gun 1 is composed of a polyacetal resin, such as Delrin TM produced by E. I. du Pont de Nemours & Company having the polyoxymethylene structure. The gun 1 has a nozzle 11 on its front end, and a paint hose 12, a power cable 13, an atomized air hose 14, a pattern air hose 15, and a paint supply valve actuating air hose 16 are connected to a rear end portion thereof.

A high voltage generator 3 and a paint supply valve 4 are built-in to the gun 1. The high voltage generator 3 has a transformer 31, a Cockcroft circuit 32, and a resistor 33 having 100 MΩ resistance. The high voltage generator 3 transforms a DC power of 24 V low voltage, which is supplied by the power cable 13, into a high voltage of −60 KV, and then outputs the high voltage to the nozzle 11. The paint supply valve 4 is operated pneumatically, and it controls on and off paint discharge operation through a nozzle opening of the nozzle 11 by retracting and advancing a needle 17.

As previously stated, in the conventional type construction, the high voltage generator 3, paint supply valve 4, and nozzle 11 are used.

A plurality of through holes are formed in the gun 1 and include a through hole 18 for connecting the paint hose 12 and the paint supply valve 4, a through hole (not shown) for electrically linking the power cable 13 and the high voltage generator 3, a through hole (not shown) for connecting the atomized air hose 14 and the nozzle opening of the nozzle 11, a through hole (not shown) for connecting the pattern air hose 15 and a pattern air opening of the nozzle 11, and a through hole (not shown) for connecting the paint supply valve actuating air hose 16 and the paint supply valve 4.

The bracket 2 is composed of an aluminum alloy. One end of the bracket 2 is fastened to the rear end of the gun 1, and the other end of the bracket 2 is fastened to the end of the robot wrist 51 by a bolt.

Figure 3:
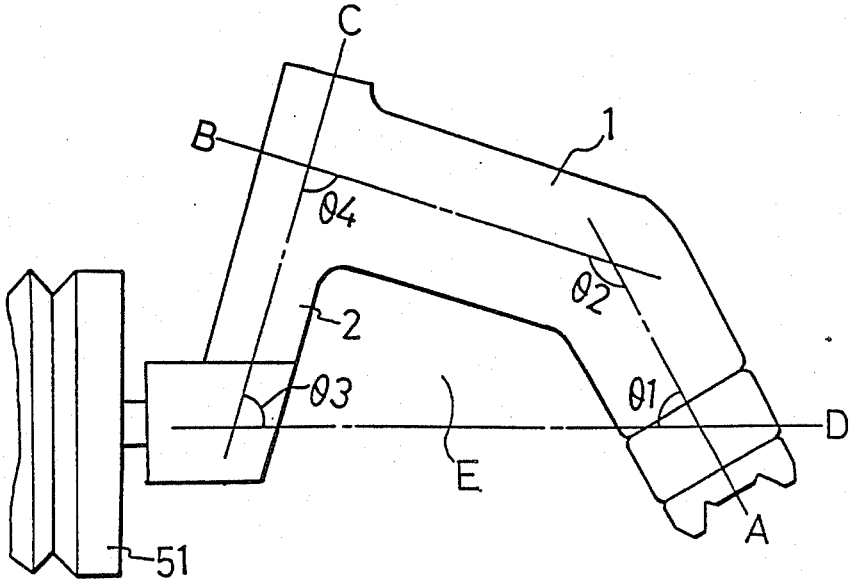
FIG. 3 is a schematic illustration explaining a geometric configuration of the electrostatic painting gun.

Next, the geometric configuration, which is one of the features of the electrostatic painting gun according to the present invention, will be explained with reference to FIG. 3. The gun 1 is bent around its middle part. The center axis A of the front end having the nozzle 11 intersects the center axis B of the rear end connected to the hoses at an angle of 135° ($\theta 2$). When the gun 1 is fastened to the robot wrist 51 with the bracket 2, the center axis C of one end of the bracket 2 intersects the center axis D of the robot wrist 51 at an angle of 75° ($\theta 3$), the center axis B intersects the center axis C at an angle of 90° ($\theta 4$), and the center axis A intersects the center axis D at an angle of 60° ($\theta 1$). Accordingly, pocket space E is formed by the gun 1, bracket 2 and the center axis D. Furthermore, the center axis B intersects the center axis D at an angle of 15° .

The operations and advantages of the preferred embodiment will be hereinafter explained. The preferred embodiment of the electrostatic painting gun according to the present invention is constructured as follows.

Figure 4:
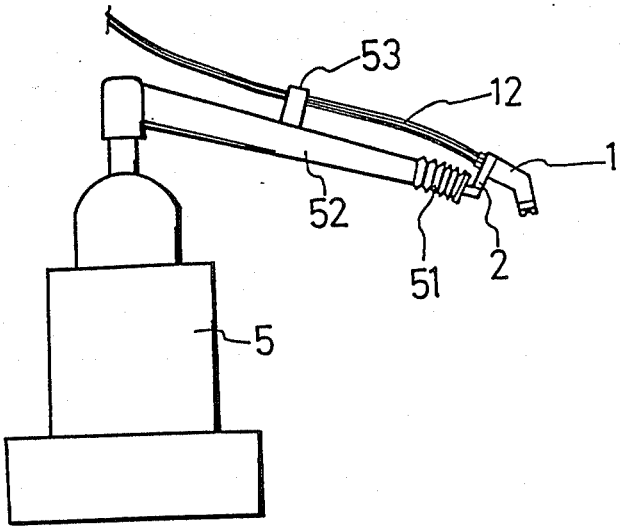
FIG. 4 is a schematic illustration showing the electrostatic painting gun fixed to a robot.

As shown in FIG. 4, the electrostatic painting gun 1 is fastened to the robot wrist 51 of a robot 5 with the bracket 2 placed in between. The power cable 13, and the hoses, such as the painting hose 12 and so on, extending from the rear end of the gun 1 are bundled together by a stay 53 disposed on a robot arm 52. Here, the center axis B of rear end of the gun 1 intersects the center axis D of the robot wrist 51 and the robot arm 52 at an angle of 15° . Hence, the hoses are disposed so as to run along the robot arm 51 and the robot wrist 52.

Paint supplied by the paint hose 12 reaches the paint supply valve 4 through the through hole 18. The needle 17 retracts and advances depending on the magnitude of the pneumatic pressure introduced through the paint supply valve actuating air hose 16. Thus, the paint discharge is controlled so as to be turned on and off. Then the discharged paint is atomized by an air stream from the atomized air hose 14, and the pattern of the atomized paint is regulated by an air stream from the pattern air hose 15. At this moment, a high voltage is applied to the nozzle 11 by the high voltage generator 3. Since the discharged and atomized paint is charged at a high voltage, the paint is attracted by an object to be painted, which is kept at the earthed voltage, and the paint adheres to the object.

Figure 5:
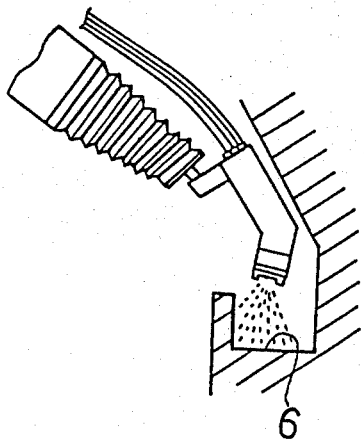
FIG. 5 shows an application of the electrostatic painting gun from the upper part to paint a minute behind an obstacle.
Figure 6:
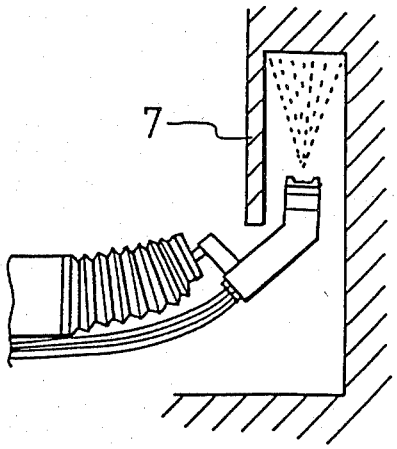
FIG. 6 shows another application of the electrostatic painting gun from the lower part to paint a minute place behind an obstacle.
Figure 7:
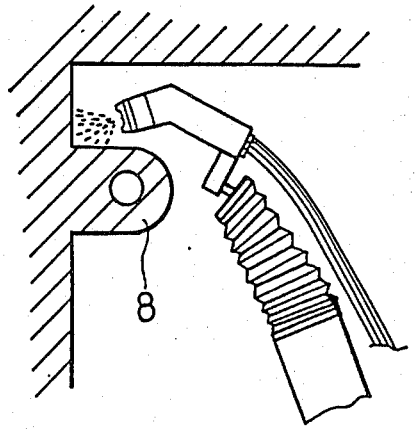
FIG. 7 shows another application of the electrostatic painting gun from another minute place.
Figure 8:
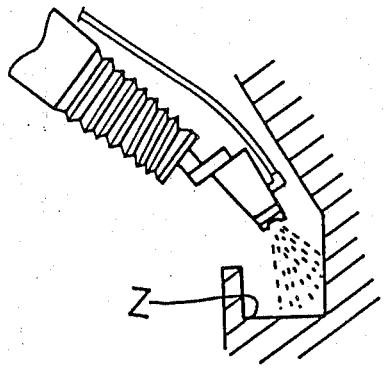
FIG. 8 (PRIOR ART)
FIG. 8 shows an application of a conventional electrostatic painting gun from the upper part to paint a minute place behind an obstacle.
Figure 9:
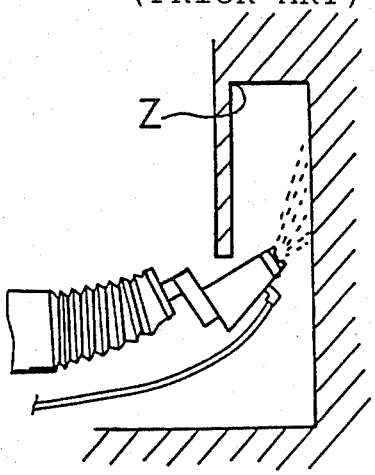
FIG. 9 (PRIOR ART)
FIG. 9 shows another application of the conventional electrostatic painting gun from the lower part to paint a minute place behind an obstacle.
Figure 10:
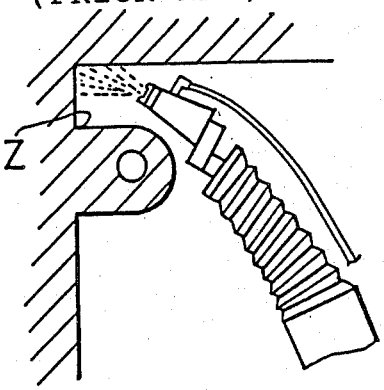
FIG. 10 (PRIOR ART)
FIG. 10 shows another application of the conventional electrostatic painting gun applied to another minute place.
Figure 11:
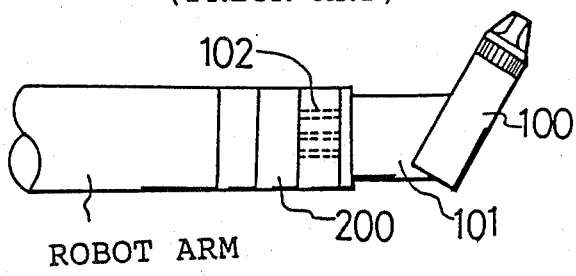
FIG. 11 (PRIOR ART)
FIG. 11 is a schematic illustration showing a conventional electrostatic painting gun fixed to a robot wrist.

The preferred embodiment of the electrostatic painting gun according to the present invention is especially useful for painting minute places, which are hard to reach, such as shown in FIGS. 5, 6 and 7.

The preferred embodiment of the electrostatic painting gun has the center axis A of the front end of the gun 1 intersecting the center axis D of the robot wrist 51 at the angle of 60° ($\theta 1$). The hoses are disposed together at the rear end. Accordingly, inner surfaces of a groove 6 shown in FIG. 5 can be painted without difficulties.

Further, the preferred embodiment of the electrostatic painting gun has the pocket space E, and the hoses are disposed altogether at the rear end. Consequently, the inner sides behind obstacles 7 and 8 shown in FIGS. 6 and 7 can also be painted without difficulties.

Thus, minute places which are hard to reach can be painted without failure, the man-hour requirements for accomplishing the same can be reduced sharply, and painting quality can be improved by using the electrostatic painting gun according to the present invention. Further, it is easy to teach the robot 5 because the nozzle opening of the nozzle 11 is disposed adjacent to the center axis D of the robot wrist 51. Furthermore, the electrostatic painting gun according to the present invention can be installed on any type of robots because the electrostatic painting gun is fastened with the bracket 2, and the hoses are disposed outside the robot wrist 51. Therefore, robots which have been used conventionally can be used without modifications.

Having now fully described the invention, it will be apparent to one of ordinary skill in the art that many changes and modifications can be made thereto without departing from the spirit of scope of the invention as set forth herein.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An electrostatic painting gun for mounting on a robot wrist, comprising:

a rod-shaped gun having a front end with a nozzle opening, and a rear end to which hoses for supplying a paint, air and power are connected, and a bent middle portion rigidly interconnecting said front end and said rear end; and a bracket, integrally connected to said rear end of said gun, extending so as to form a trapezoid-like pocket space between said bracket and said gun, and having a fastener portion to be fastened with said robot wrist on an extension end portion thereof, wherein the center axis of said robot wrist fixed with said fastener portion and the center axis of said front end of said gun intersect at an angle of between 45° to 60°, and the center axis of said front end of said gun and the center axis of the rear end of said gun intersect at an angle of between 120° to 150°.

2. An electrostatic painting gun according to claim 1, wherein said nozzle opening of said gun is disposed adjacent the extension of center axis of said robot wrist.

3. An electrostatic painting gun according to claim 1, wherein said hoses are disposed adjacent and parallel to the center axis of said rear end of said gun.

4. An electrostatic painting gun according to claim 1, further comprising a high voltage generator mounted on said gun and a low voltage power cable connected to said generator.

5. An electrostatic painting gun for mounting on a robot wrist, comprising:

a rod-shaped gun having a front end with a nozzle opening, and a rear end to which hoses for supplying a paint, air and power are connected, and a bent middle portion rigidly interconnecting said front end and said rear end; and a bracket, integrally connected to said rear end of said gun, extending so as to form a trapezoid-like pocket space between said bracket and said gun, and having a fastener portion to be fastened with said robot wrist on an extension end portion thereof. wherein the center axis of said robot wrist and the center axis of the rear end of said gun intersect at an angle of 30° or less.

* * * * *